US005375280A

United States Patent [19]

O'Sullivan et al.

[11] Patent Number: 5,375,280

[45] Date of Patent: Dec. 27, 1994

[54] APPARATUS TO ASSIST INVALID MOTION ABOUT THE BED

[76] Inventors: Donald O'Sullivan, 3930 Derby Dr., Syracuse, N.Y. 13215; Angela K. Niemeyer, 1223 James St., Syracuse, N.Y. 13203

[21] Appl. No.: 49,677

[22] Filed: Apr. 16, 1993

[51] Int. Cl.[5] ..... A47C 21/00; A47G 9/00

[52] U.S. Cl. ..... 5/162; 5/81.1; 5/495; 5/496

[58] Field of Search ..... 4/495–497, 4/499, 625, 626, 662, 81.1, 89.1

[56] References Cited

U.S. PATENT DOCUMENTS

| | | | |
|---|---|---|---|
| 3,284,816 | 11/1966 | Laubsch | 5/81.1 |
| 3,364,506 | 1/1968 | Hale | 5/81.1 |
| 3,829,914 | 8/1974 | Treat | 5/81.1 |
| 4,473,912 | 10/1984 | Scheidel et al. . | |
| 4,653,131 | 3/1987 | Diehl . | |
| 4,675,925 | 6/1987 | Littleton . | |
| 4,723,327 | 2/1988 | Smith . | |
| 4,825,489 | 5/1989 | Ross | 5/497 |
| 4,937,904 | 7/1990 | Ross | 5/497 |
| 5,060,327 | 10/1991 | Celestina et al. . | |
| 5,138,731 | 8/1992 | Harcrow, Jr. | 5/89.1 X |
| 5,214,813 | 6/1993 | Gastle et al. | 5/625 |

*Primary Examiner*—Michael F. Trettel
*Attorney, Agent, or Firm*—Harris Beach & Wilcox

[57] ABSTRACT

A apparatus for use in assisting a person in getting into or out of bed, adjusting position on a bed, or performing exercises on a bed. The apparatus comprises a sheet having one or more grasp able fabric handles situated in convenient positions which can be grasped by a person needing assistance in adjusting position, exercising, or entering or exiting a bed. The apparatus is secured firmly to a mattress be means of straps affixed on its bottom surface, so that stress caused by the use of the handles will not dislodge it from the bed.

16 Claims, 3 Drawing Sheets

APPARATUS TO ASSIST INVALID MOTION ABOUT THE BED

BACKGROUND OF THE INVENTION

This invention relates to an apparatus that may be used by a person who has difficulty in getting in and out of bed and/or moving from one position to another while in bed, and/or performing exercises while in bed.

It is often the case that an invalid or person with some physical condition which restricts or inhibits his or her movement whether due to weakness, restricted range of motion, pain or other cause, nonetheless desires to operate totally or as much as possible without assistance from others. For such a person, getting into or out of bed, or adjusting position in bed, as for example, from a supine to a side position, may be difficult or impossible. Such a person may also be required to or choose to perform exercises while in bed in order to help alleviate a medical condition or retain a degree of physical fitness.

Getting into or out of bed may be somewhat facilitated by the use of a hospital type bed—which can be raised or lowered. Bowever these beds are expensive, and not portable to other locations. Furthermore the installation of such a bed is inconvenient and bothersome in the case of short term conditions such as sprains or injuries. In addition, while such beds may assist in certain activities, such as exiting the bed, they do not assist in others, such as rolling to or from a side position. Nor would such a bed be of assistance in performing a wide variety of exercise as may be necessary or desirable for a bedridden or other person.

There are a number of patents which disclose devices to aid third parties in manipulating bedridden individuals. These devices may assist in placing an individual into bed, removing him or her from bed, or in positioning the individual upon the bed so as to avoid bed-sores, facilitate treatment, change bed linen, and so forth.

Thus, for example, U.S. Pat. No. 4,675,925 to Littleton discloses a sheet which may be used by an attendant to manipulate a bedridden patient. The patient may be rolled from one position to another using this sheet and, by affixing handles at the edge of the sheet to different parts of a bed, may be held in a given position.

U.S. Pat. No. 4,723,327 to Smith describes a sheet of flexible fabric used to transport and move a bedridden patient. This device contains looped handles at each corner, with the size of each of the loops being adjustable to facilitate ease of use by an attendant.

U. S. Pat. No. 4,473,912 concerns a backboard with carrying handles and tie-down straps for transporting patients.

None of these devices, however, is suitable for a person to use in assisting him or herself to get in or out of bed or for positioning or moving him or herself while lying or reclining in bed or in exercising in bed. Rather they are all designed to assist a third party in handling or moving a bedridden person.

SUMMARY OF THE INVENTION

It is therefore a primary object of the present invention to provide an apparatus which will assist a person in getting into and out of a bed, positioning him or herself while lying in bed, or performing exercises while in bed.

It is a further object of this invention to provide a device which is relatively inexpensive and portable which will assist a person in getting into and out of a bed, positioning him or herself while lying in bed, or performing exercises while in bed.

These and other objects of the present invention are attained by an apparatus for use in assisting a person in the activities of getting into bed, getting out of bed, shifting position in bed, and performing exercises in bed, that comprises a bed sheet formed of a fabric and having opposed top and bottom edges and side edges, and a top surface upon which a person may lie, kneel or sit and a bottom surface which contacts a mattress which said sheet covers; a plurality of hand-engageable fabric handle means firmly attached to the top surface of said sheet, said handle means having a loop capable of being grasped by a person who is lying, kneeling, or sitting upon said sheet; and an elongated band means attached at each end to said sheet, said band means arranged to pass underneath said mattress to prevent the sheet from being dislodged when the handle means are stressed by a person situated upon the sheet.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
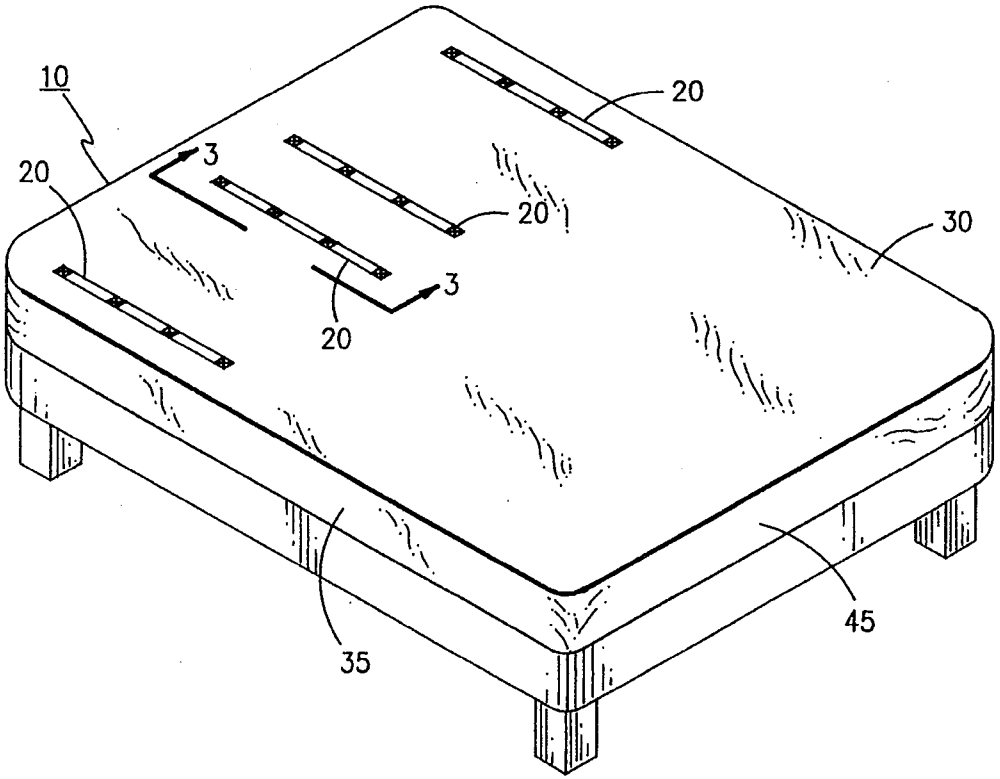
FIG. 1 is a perspective view of one embodiment of the apparatus of the present invention as fitted on a bed.

Referring now to the drawings in greater detail, FIG. 1 shows one embodiment of the instant invention. To the upper surface 30 of a sheet 10, fabricated preferably from a sturdy, yet comfortable fabric such as a cotton-polyester blend, are firmly attached a number of spaced-apart handle means 20. These handle means are also comprised of a sturdy, yet comfortable fabric, which may be the same as that making up the rest of the sheet. Thus they will not serve to irritate the person using the sheet, which is especially important for bedridden persons who may be subject to bedsores and other complaints. In this embodiment four handle means are shown, two close to the outer edges of one end of the sheet, and two close together near the center of the same end of the sheet.

Figure 3:
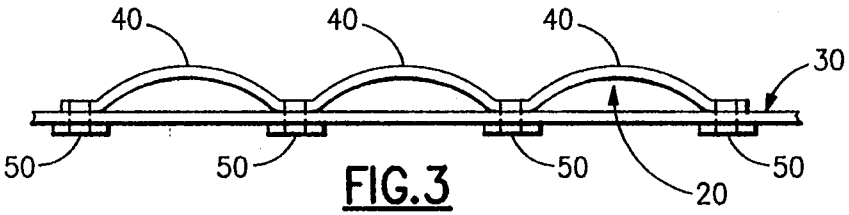
FIG. 3 is a cross section view of the apparatus taken along line 3—3 of FIG. 1.
Figure 5:
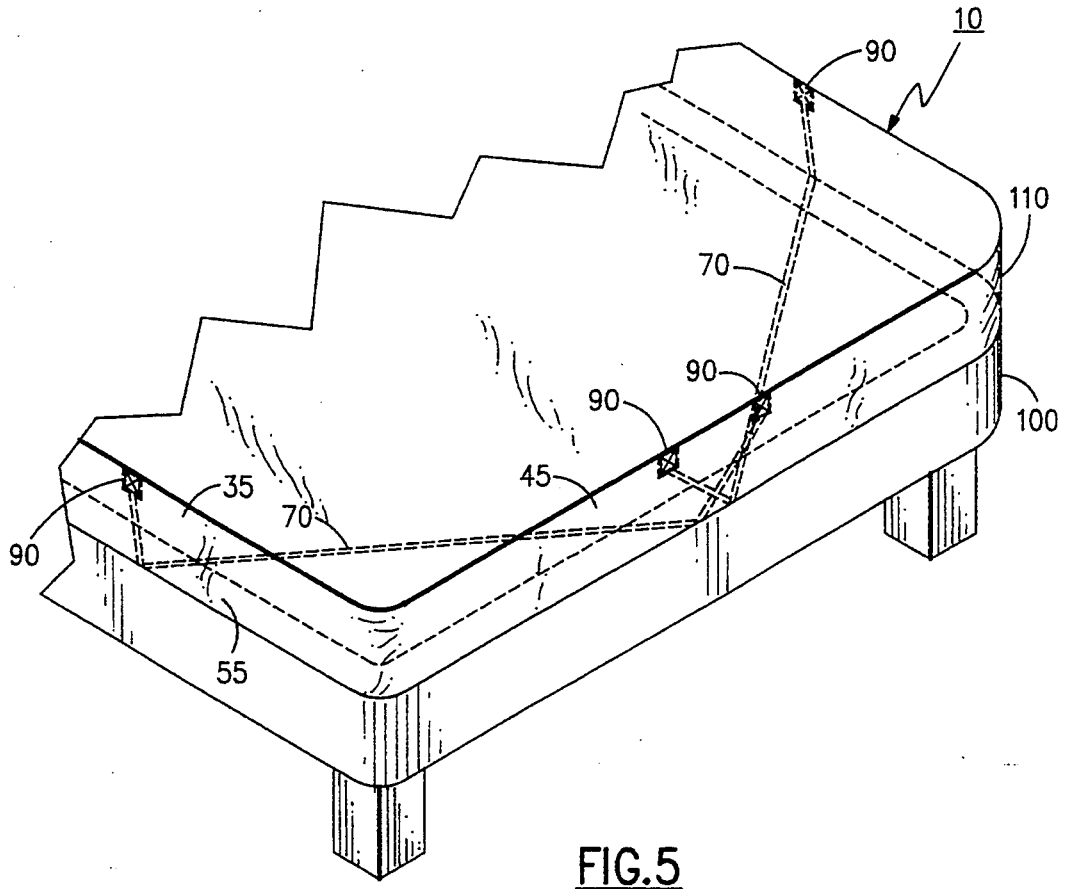
FIG. 5 is a fragmentary perspective view of the apparatus fitted on a bed illustrating the securement of the sheet to the bed.
Figure 6:
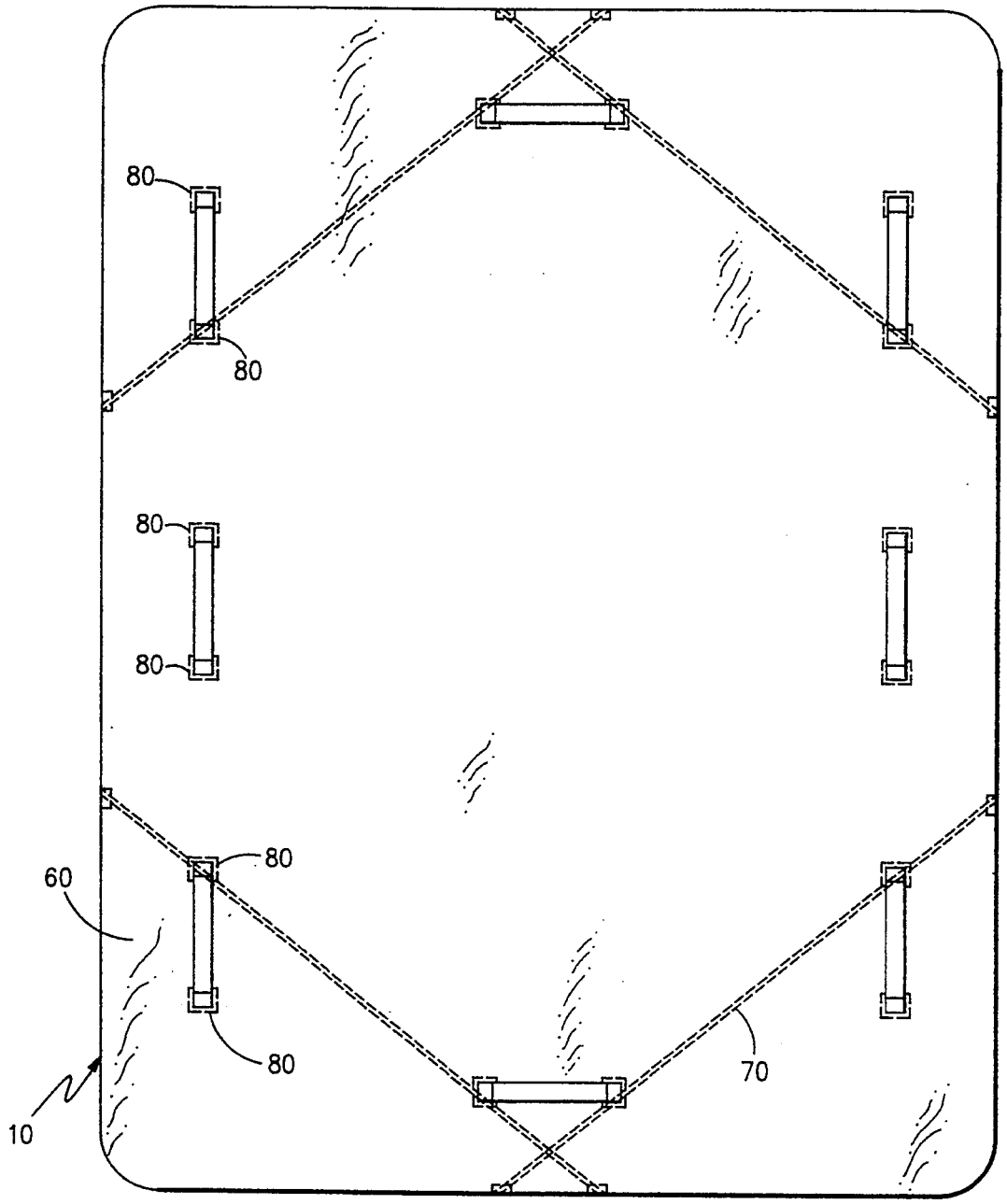
FIG. 6 is a top plan view of a second embodiment of the apparatus showing in phantom bands means and reinforcing patch on the bottom of the sheet.

The handle means 20 of this embodiment are shown in more detail in FIG. 3, each handle means being firmly fixed to the sheet surface 30 at four spaced-apart points 50 so that three loops 40 are formed across the surface of the sheet 30. Although the loops are shown projecting from the top of the sheet, for the purpose of demonstrating their spacing and attachment, in fact they lie flat on the surface of the sheet to avoid irritating the person lying on the sheet. It is very important that the handle means be firmly affixed to the sheet and that the sheet in this region be capable of resisting considerable pulling force, as the user may exert a great deal of force while relying on the handle means for support or stability. Thus the handle means are shown in FIG. 5 in detail 90 as being stitched to the sheet along 6 lines—that being a square with diagonals inside. Furthermore, as can be seen in FIG. 6, the fabric is reinforced by an additional patch of the same fabric 80, sewn on the underside of the sheet, so that the stitching passes through handle, sheet, and reinforcing patch. In this embodiment each handle means may be grasped in any one of three places, subject to the position of the person using the apparatus, and depending upon what form of assistance is needed.

Figure 2:
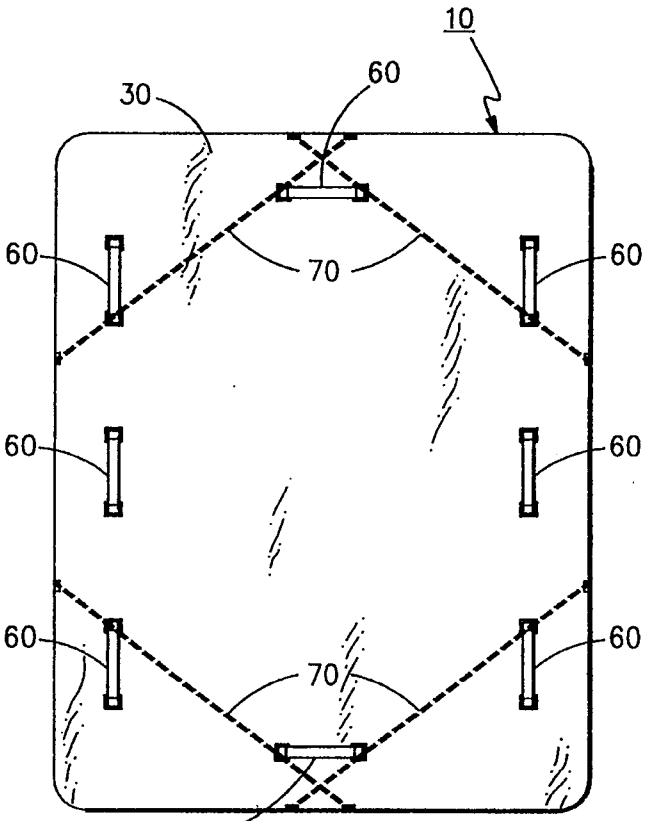
FIG. 2 is a top plan view of a second embodiment of the apparatus.
Figure 4:
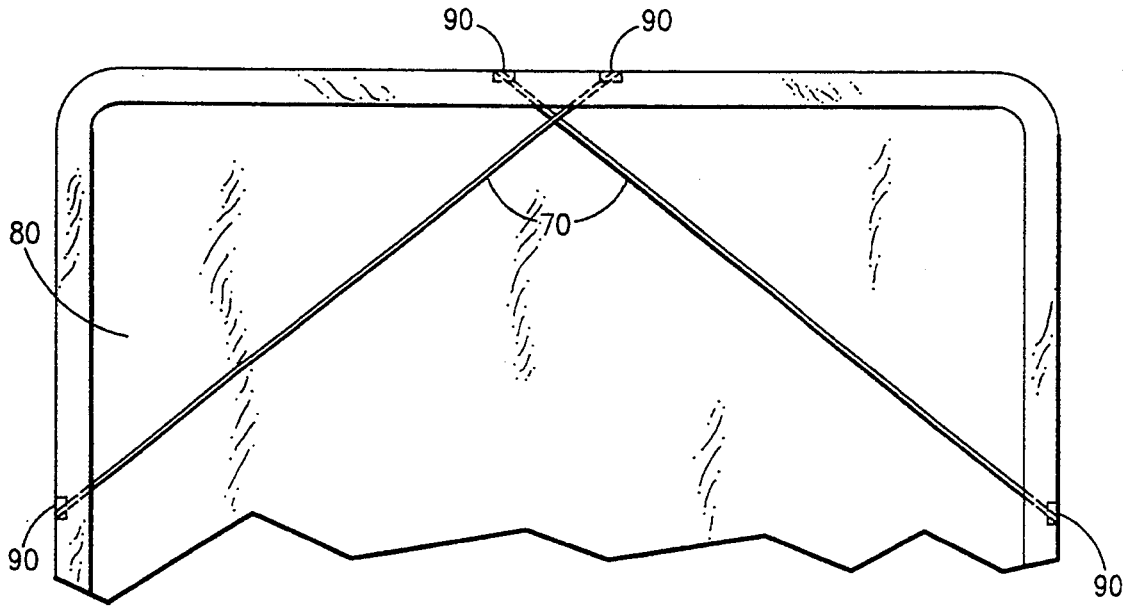
FIG. 4 is a fragmentary bottom plan view of the apparatus.

In FIG. 2 an alternative embodiment of the invention is shown, with eight handles placed around the perimeter of the sheet, three on each side and one at each end. Bands in the form of elastic straps 70 extend across the under surface of the sheet, as demonstrated in FIGS. 4 and 6, each secured at at least two points 90, so that each strap may pass under the mattress 110, thus securing the sheet to the mattress. This extra security allows considerable force to be exerted on the sheet in an upward or sideways plane, or in an intermediate plane, via one or more handle means, without pulling the sheet from the bed. In the preferred embodiment, as demonstrated in FIGS. 4 and 6, there are 4 straps each of which is attached to an apron along the edges of the sheet (which apron results in the sheet being "fitted"). Each apron is comprised of two side aprons 35 and two end aprons 45, edged with elastic. Each end of each strap is attached at a point near a corner of the sheet, so that each strap passes diagonally across the corner of the sheet. Furthermore at each end of the sheet the straps 70 are attached closer to its neighboring strap's corner than its own. This results in the straps crossing each other as well as fitting underneath the mattress 110, holding it firmly between the mattress and a platform or box spring 100. The edges of each apron 55 also tuck underneath the mattress as can be seen in phantom in FIG. 5. Each of these features adds to the stability of the arrangement and acts to keep the sheet firmly in place even when considerable force is being placed on one or more handle means.

While this invention has been explained with reference to the structure disclosed herein, it is not confined to the details set forth and this application is intended to cover any modifications and changes, including, but not limited to the number and positioning of straps and handles, as may come within the scope of the following claims:

What is claimed is:

1. Apparatus for use in assisting a person in the activities of getting into bed, getting out of bed, shifting position in bed, and performing exercises in bed, that comprises:

a bed sheet formed of a fabric and having opposed top and bottom edges, side edges, two top corners and two bottom corners, and a top surface upon which a person may lie, kneel or sit and a bottom surface which contacts a mattress which said sheet covers, wherein an upper surface of said mattress is entirely covered by said sheet;

a plurality of hand-engageable fabric handle means firmly attached to the top surface of said sheet, said handle means being situated away from said edges of said sheet, each said handle means having at least one loop capable of being grasped by a person who is lying, kneeling, or sitting upon said sheet; and elongated band means attached at each end to said sheet, said band means arranged to pass underneath said mattress to prevent the sheet from being dislodged when the handles are stressed by a person situated upon the sheet.

2. The apparatus of claim 1 wherein said handle means are placed around the perimeter of said sheet, aligned parallel to said edges.

3. The apparatus of claim 1 wherein each handle means comprises a long strip of fabric which is firmly affixed to the sheet at at least three points to form a series of hand engageable loops.

4. The apparatus of claim 3 wherein a plurality of said fabric strips are placed in spaced apart alignment with the side edges of said sheet.

5. The apparatus of claim 1 where said handles are comprised of the same fabric as the sheet.

6. The apparatus of claim 5 where said fabric is a blend of polyester and cotton.

7. The apparatus of claim 6 further including stitching means for securing the handle means to said sheet.

8. The apparatus of claim 7 that further includes a reinforcing patch extending beyond the region of said handle means and attached by said stitching means to the bottom surface of the sheet.

9. The apparatus of claim 1 where said band means comprises a series of elastic straps.

10. The apparatus of claim 9 wherein an elastic strap is located at each corner of said sheet and extends diagonally between the edges forming said corner.

11. The apparatus of claim 10 wherein the straps at the top corners of the sheet cross over each other and the straps at the bottom corners of the sheet similarly cross over each other.

12. The apparatus of claim 11 where the sheet includes top, bottom and side panels perpendicularly disposed to the top surface of said sheet.

13. The apparatus of claim 12 where each panel has an inwardly turned bottom piece arranged so as to fit beneath the mattress, the edge of said bottom piece being affixed by stitching means to elastic.

14. The apparatus of claim 13 where the ends of the bands are secured to the panels.

15. Apparatus for use in assisting a person in the activities of getting into bed, getting out of bed, shifting position in bed, and performing exercises in bed, that comprises:

a bed sheet formed of a fabric and having opposed top and bottom edges and side edges, and a top surface upon which a person may lie, kneel or sit and a bottom surface which contacts a mattress which said sheet covers;

a plurality of hand-engageable fabric handle means firmly attached to the top surface of said sheet, each handle means having at least one loop capable of being grasped by a person who is lying, kneeling, or sitting upon said sheet, wherein each handle means comprises a long strip of fabric which is firmly affixed to the sheet at at least two points to form at least one hand engageable loop; and elongated band means attached at each end to said sheet, said band means arranged to pass underneath said mattress to prevent the sheet from being dislodged when the handles are stressed by a person situated upon the sheet.

16. Apparatus for use in assisting a person in the activities of getting into bed, getting out of bed, shifting position in bed, and performing exercises in bed, that comprises:

a bed sheet formed of a fabric and having opposed top and bottom edges and side edges, and a top surface upon which a person may lie, kneel or sit and a bottom surface which contacts a mattress which said sheet covers;

a plurality of hand-engageable fabric handle means firmly attached to the top surface of said sheet, each handle means having at least one loop capable of being grasped by a person who is lying, kneeling, or sitting upon said sheet, wherein each handle means comprises a long strip of fabric which is firmly affixed to the sheet at at least three points to form a series of hand engageable loops, and wherein said handle means are placed around a perimeter of said sheet, aligned parallel to said edges; and elongated band means attached at each end to said sheet, said band means arranged to pass underneath said mattress to prevent the sheet from being dislodged when the handles are stressed by a person situated upon the sheet.

* * * * *